US008678068B1

(12) United States Patent
Hobart et al.

(10) Patent No.: US 8,678,068 B1
(45) Date of Patent: Mar. 25, 2014

(54) BRACKET AND SPINE MOUNTED CORNICE AND METHOD OF USE

(75) Inventors: Robert A. Hobart, Wesley Chapel, FL (US); William T. Walker, Brooksville, FL (US)

(73) Assignee: Cornicesmith, LLC, Brooksville, FL (US)

( * ) Notice: Subject to any disclaimer, the term of this patent is extended or adjusted under 35 U.S.C. 154(b) by 0 days.

(21) Appl. No.: 13/324,422

(22) Filed: Dec. 13, 2011

Related U.S. Application Data

(60) Provisional application No. 61/422,398, filed on Dec. 13, 2010.

(51) Int. Cl.
*A47H 2/00* (2006.01)

(52) U.S. Cl.
USPC ..... 160/38; 248/497

(58) Field of Classification Search
USPC ..... 160/38, 39, 19, 902; 248/254, 262, 251, 248/248, 301, 497
See application file for complete search history.

(56) References Cited

U.S. PATENT DOCUMENTS

| | | | | | |
|---|---|---|---|---|---|
| 236,028 | A | * | 12/1880 | Herrmann | 160/39 |
| 2,299,443 | A | * | 10/1942 | Walmsley | 248/497 |
| 2,501,133 | A | * | 3/1950 | Levy | 160/39 |
| 2,570,731 | A | * | 10/1951 | Susnow | 248/247 |
| 2,661,098 | A | * | 12/1953 | Wannop | 211/106.01 |
| 2,783,014 | A | * | 2/1957 | Kenney | 248/263 |
| 2,974,918 | A | * | 3/1961 | Voigtlander | 248/201 |
| 3,183,596 | A | * | 5/1965 | Shaw | 33/481 |
| 3,216,680 | A | * | 11/1965 | Musante | 248/497 |
| 3,435,876 | A | * | 4/1969 | Toti | 160/38 |
| 3,912,211 | A | * | 10/1975 | Topf | 248/489 |
| 4,246,951 | A | * | 1/1981 | Givens | 160/39 |
| 4,277,903 | A | * | 7/1981 | Crossot | 40/791 |
| 4,354,300 | A | * | 10/1982 | Anderle | 24/343 |
| 4,935,988 | A | * | 6/1990 | Ford et al. | 16/87.4 R |
| 5,042,549 | A | * | 8/1991 | Roberts | 160/39 |
| 5,042,553 | A | * | 8/1991 | Schaffer et al. | 160/178.1 R |
| 5,353,857 | A | * | 10/1994 | Anderson | 160/178.1 R |
| 5,454,542 | A | * | 10/1995 | Hart | 248/494 |
| 5,597,025 | A | | 1/1997 | Forkner | |
| 5,727,325 | A | * | 3/1998 | Mussell | 33/429 |
| 5,810,317 | A | * | 9/1998 | Macchi | 248/475.1 |
| 6,315,026 | B1 | | 11/2001 | Ross | |
| 6,364,260 | B1 | * | 4/2002 | Lorincz et al. | 248/215 |
| 6,931,735 | B1 | * | 8/2005 | Clark et al. | 33/194 |
| 7,048,028 | B2 | * | 5/2006 | Wolfe et al. | 160/173 R |

* cited by examiner

*Primary Examiner* — David Purol
(74) *Attorney, Agent, or Firm* — Robert J. Varkonyi; Smith & Hopen, P.A.

(57) ABSTRACT

A bracket designed to reduce mounting system failures was designed, having a mounting surface and an angled clip on the lower edge of the mounting surface providing backward pressure for any hardware mounted onto the bracket. The sides of the mounting surface may include cut-outs for aligning multiple brackets. An optional screw-mounting system comprising corresponding holes in the clip, or a tab-mounting system, provide for connecting accessories to the bracket. A cornice centered around a spine element mounted to the bracket. The cornice has a front face and returns attached to either side of the front face, forming the structure. The spine is designed to fit into a plurality of brackets bent to provide backward pressure on the cornice, pulling it toward a mounting surface. The cornice is mounted by fixing the brackets onto a mounting surface and placing the spine of the cornice onto the brackets.

15 Claims, 12 Drawing Sheets

BRACKET AND SPINE MOUNTED CORNICE AND METHOD OF USE

CROSS REFERENCE TO RELATED APPLICATION

This application claims priority to U.S. Provisional Patent Application No. 61/422,398, entitled "Spine Centered Cornice System and Method of Mounting", filed on Dec. 13, 2010, the contents of which are herein incorporated by reference

FIELD OF INVENTION

This invention relates to cornices. Specifically, the invention discloses the construction and mounting of a cornice designed around a spine structure and a complementary mounting bracket

BACKGROUND OF INVENTION

Cornice moldings are horizontal decorative molding that crown furniture elements, such as a door or window. Window cornices are designed to conceal or decorate the area above a window and may also be used to conceal a curtain rod. However, windows vary greatly in width forcing the industry to recognize the majority of cornices require custom manufacture and/or installation. The manufacture and installation of custom cornices is expensive and time consuming. As a result, the art has developed some cornices that allow for generic manufacture of the cornice. For example, Forkner (U.S. Pat. No. 5,597,025) developed a cornice having sectional pieces to allow a user to fit the cornice to the width of the window.

Further, the installation can be extremely complicated. A tape measure or some other measuring device is typically used to determine mounting locations for brackets. However, inaccurate placement due to level issues, mistakes in marking a proper hole location or general lack of skill can cause misalignment of the holes drilled with those preexisting in the mounting hardware, resulting in improperly positioned or hung cornices, and damage to the wall.

L-shaped, or right-angle, brackets are typically used to affix the cornice to the window, as seen in Ross (U.S. Pat. No. 6,315,026). The L-shaped bracket is attached to the wall or window and then to the cornice. Before attaching the cornice to the L-shaped bracket the installer must pay particular attention to centering the cornice over the window as well as assuring they are level. In addition, screws are typically used to secure the cornice to the L-Bracket by applying them up underneath the cornice. Due to the heft and bulk of a cornice, placing the cornice on such a bracket and maneuvering a tool inside the cornice housing can result in fatigue, injury, and/or damage to the bracket, wall, and/or cornice. Further, the proper positioning of the cornice during installation can be particularly challenging, resulting in a gap between the wall and cornice.

Another option to hang the cornice is using a piece of wood cut at a 45 degree angle. This piece is attached to the wall or surface with the bevel up. Another complementary piece of wood is cut at an opposing 45 degree angle and attached to the back of the cornice. The cornice may then be hung by interlocking the opposing pieces. The disadvantage is that the cornice will have to be hung above the top edge of the window, a distance of at least the width of the two opposing interlocking pieces plus the thickness of the top piece (strong back) of the cornice. Further, the wooden blocks do not fix the cornice to the wall and allow horizontal movement of the cornice. Such movement is not preferred, as the cornice may be moved from the wall-affixed block, causing the cornice to fall.

The present invention is designed to address the shortcomings of the present art.

SUMMARY OF THE INVENTION

Conventional brackets typically have a 90 degree angle, forming a vertical support for hardware, like a cornice, blind, or other window treatment. This places a large amount of stress on the bracket, introducing areas of mechanical failure. As such, the disclosed bracket addresses these issues through a novel design. The bracket has a flat plate with an upper edge and lower edge, and a wall face and indicator face, and a clip disposed on the lower edge and bent toward the indicator face, forming a support face disposed below the lower edge of the flat plate and a clip face disposed along the bent portion of the clip. The clip is bent at a sufficient angle to provide backward pressure for any hardware mounted onto the bracket. Typically, the angulation of the bend is between 30 degrees and 60 degrees, such as 45 degrees. The bracket is optionally made of carbon steel, galvanized steel, low alloy steel, stainless steel, surgical steel, aluminum, magnesium, titanium alloy, thermoplastic, Kevlar, carbon fiber, or fiberglass.

At least one hole is drilled into the flat plate, permitting mounting of the bracket onto a wall or other mounting surface. The one or more holes are optionally oval, rectangular, or circular. In some variations of the bracket, two holes are provided, and have the same size and shape. Other variations use three holes. Where three holes are used in the bracket, the outer most holes are the same size and shape, while the middle hole may also be the same size and shape as the outermost holes or vary in both size and/or shape from the outermost holes. In variations where the middle hole is not the same size and/or shape as the outermost holes, the middle hole may be an oval or hole of any size or length.

The sides of the bracket's flat plate may include at least one V-cutout disposed on one or more side edges of the flat plate. Some variations use two V-cut-outs, one on either side edge of the plate. A level line is optionally disposed on the indicator face of the plate between the plurality of V-cutouts.

The bracket also optionally includes a screw-mounting system, comprising a plurality of holes disposed on the support face of the clip; and corresponding holes disposed on the clip face of the clip to permit placement and attachment of accessory screws to the bracket. Alternatively, the bracket may use a tab-mounting system, which comprises a plurality of square or rectangular openings disposed on the support face of the clip, adapted to accept tabs from an accessory.

The bracket may be used to attach any hardware, such as a window treatment. A cornice was designed for use with the bracket, and is centered around a spine element that is complementary and adapted to engage the bracket. The angulation of the bracket's angled clip attaches to the spine, supporting the spine on a vertical surface, like a wall. The cornice spine may be made of any material provided it is able to support the weight of the cornice. The cornice spine typically runs the length of the cornice but it is not required. The cornice optionally includes a front and two side returns. Other variations include the front and side returns, as well as a strongback. The spine is optionally connected to the front, the two side returns, or to the strongback, using any known mounting hardware. Exemplary attachments include screwing or nailing the cornice spine to the cornice, commercial adhesives, dovetails, box joints, mortise and tenon, biscuits, splines and welding using metallic or non-metallic materials.

The cornice may be made of materials known in the art, and may include decorations, such as a decorative relief. Non-limiting examples of materials include wood, plastic, metal, glass, ceramic or any other material or combination of. The cornice may also be used to house hardware for other window treatments, such as blinds, shades, and other treatments known in the art. The mounting hardware is optionally connected to an interior face of the front face, the side returns, and/or the strongback, and may be designed or adapted to accept curtain rods, lighting, blind hardware, hooks, or rings. Exemplary, non-limiting examples of mounting hardware include screws, U-joints, dowels, pins, clips, brackets, hooks, Velcro, nuts and bolts, and rails.

The edges of the cornice which contact the wall or mounting surface, such as the edges of the side returns and the strongback, may also include a coating. Exemplary coatings include Teflon, polyester, para-phenylenediamine and terephthaloyl chloride polymer, carbon fiber, expanded PTFE, meta-phenylenediamine, terephthaloyl chloride polymer, nylon, fiber glass, cotton, polypropylene, latex, silicone, polyurethane, polyisoprene, polystyrene and polybutadiene polymer, urethane, polyethylene, polyisoprene, polyvinylchloride, ethylene propylene diene monomer, neoprene, styrene butadiene, cornstarch powder, graphite, Nomex, nylon, fiber glass, cotton, Gore-Tex, Kevlar, and carbon fiber.

The bracket and cornice may be installed by positioning a plurality of holes onto a mounting surface, like a wall, and drilling the plurality of holes into the mounting surface. A plurality of brackets are mounted onto the mounting surface using the one or more holes disposed on the flat plate. Optionally, where the brackets include the V-cut-out, the brackets are aligned during the mounting by running a plumb line from the one or more V-cutouts disposed on a first bracket to the at least one V-cutout disposed on a second bracket.

The cornice is then fixed to the brackets using the cornice spine and the bracket's clip. Because the spine and clip are complementary, the spine slides into the clip and fits into the angled bend of the clip. Advantageously, the angle provides backward pressure to the spine, moving the weight of the cornice to the base on the clip, i.e. at the angled section, and on the wall or other mounting surface. Where the cornice includes a front face and side returns, the edges of the side returns fit against the wall or mounting surface.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
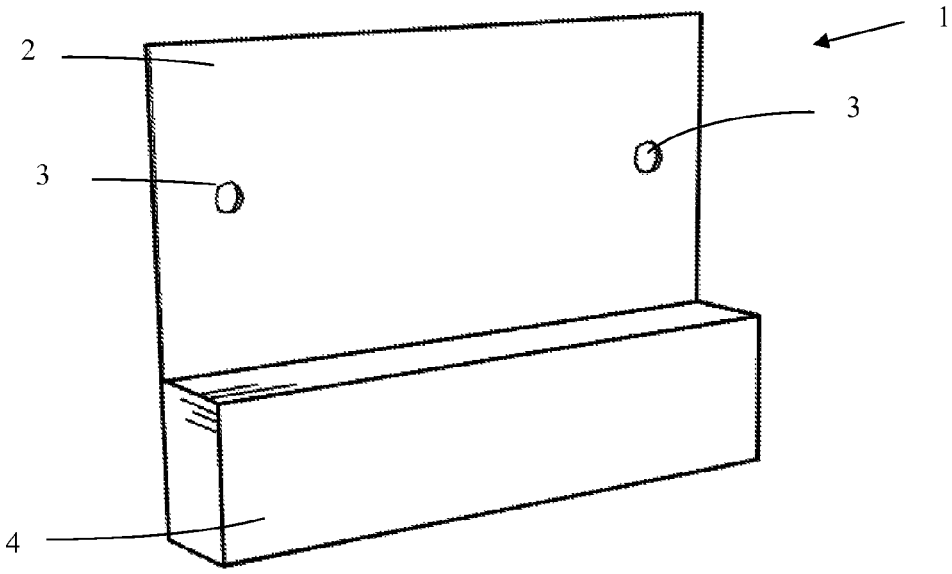
FIG. 1 is a diagram of a first embodiment of the jig of the present invention.

As used herein, "about" means approximately or nearly and in the context of a numerical value or range set forth means ±15% of the numerical.

The benefit of the inventive cornice is that the brackets can be easily installed and leveled and that the cornice can then be hung and adjusted left or right by simply sliding the cornice to the proper position. In addition, the top of the cornice can be hung very close to the top of the window opening as the brackets hang below the window top providing a low hanging point. Furthermore, window brackets can be easily placed at any point along the length of the cornice to provide additional support while still allowing the cornice to be hung at the window top. This method provides benefits of ease of installation, lower hanging, simple adjustment, and excellent strength characteristics due to shear strength as opposed to traditional methods.

As used herein, "complementary" means the elements are sized and shaped to allow at least one element from one complementary half to engage at least one element from the opposing complementary half.

As used herein, "about" means approximately or nearly and in the context of a numerical value or range set forth means ±15% of the numerical.

As used herein, "substantially" means largely if not wholly that which is specified but so close that the difference is insignificant.

As used herein, "thermoplastic" means a polymer that turns to a solid, glassy state when at room temperature. Exemplary thermoplastics include acrylonitrile butadiene styrene (ABS), acrylic (PMMA), cyclic olefin copolymer (COC), ethylene-vinyl acetate (EVA), ethylene vinyl alcohol (EVOH), fluoroplastics, such as PTFE, FEP, PFA, CTFE, ECTFE, and ETFE, Kydex (an acrylic/PVC alloy), liquid crystal polymer (LCP), polyoxymethylene (POM or Acetal), polyacrylates (acrylic), polyacrylonitrile (PAN or acrylonitrile), polyamide (PA or nylon), polyamide-imide (PAI), polyaryletherketone (PAEK or ketone), polybutadiene (PBD), polybutylene (PB), polychlorotrifluoroethylene (PCTFE), polycyclohexylene dimethylene terephthalate (PCT), polycarbonate (PC), polyhydroxyalkanoates (PHAs), polyketone (PK), polyester, polyetherketoneketone (PEKK), polyetherimide (PEI), polyethersulfone (PES), chlorinated polyethylene (CPE), polyimide (PI), polymethylpentene (PMP), polyphenylene oxide (PPO), polyphenylene sulfide (PPS), polypropylene (PP), polystyrene (PS), polysulfone (PSU), polytrimethylene terephthalate (PTT), polyurethane (PU), polyvinyl acetate (PVA), styrene-acrylonitrile (SAN).

As used herein, "low alloy steel" means an alloy metal comprising iron and carbon, i.e. steel, containing molybdenum, manganese, chromium, nickel, or a combination thereof.

As used herein, "window accessory" means any textile or material used to trim or modify a window. Examples include full curtains, panel curtains, blinds, including venetian blinds, cellular blinds, wood blinds, vertical blinds, and roman shades, valances, drapes, and shades.

Example 1

A jig allows a user to identify and correctly place holes in a wall or other surface for mounting an inventive bracket. Jig 1, seen in FIG. 1, comprises flat plate 2 having an upper edge and lower edge, and a wall face and indicator face. Position holes 3 are disposed in indicator face 2, and correspond to the mounting holes of an inventive bracket. Stop 4 is disposed on the lower edge of flat plate 2 and on the wall face of the jig. Stop 4 allows a user to place the jig against the top of a window opening and the upper edge extending upward toward the ceiling. By orienting jig 1 in this manner, the indicator face of the jig provides the correct location for drilling mounting holes for an inventive bracket. A drill can now be used in position holes 3, or the wall or surface marked for forming mounting holes. The jig is also designed such that placing the jig above the window trim allows a user to drill the position holes so that the bracket can be installed above the window trim and the cornice hung without interference from the trim.

Figure 2:
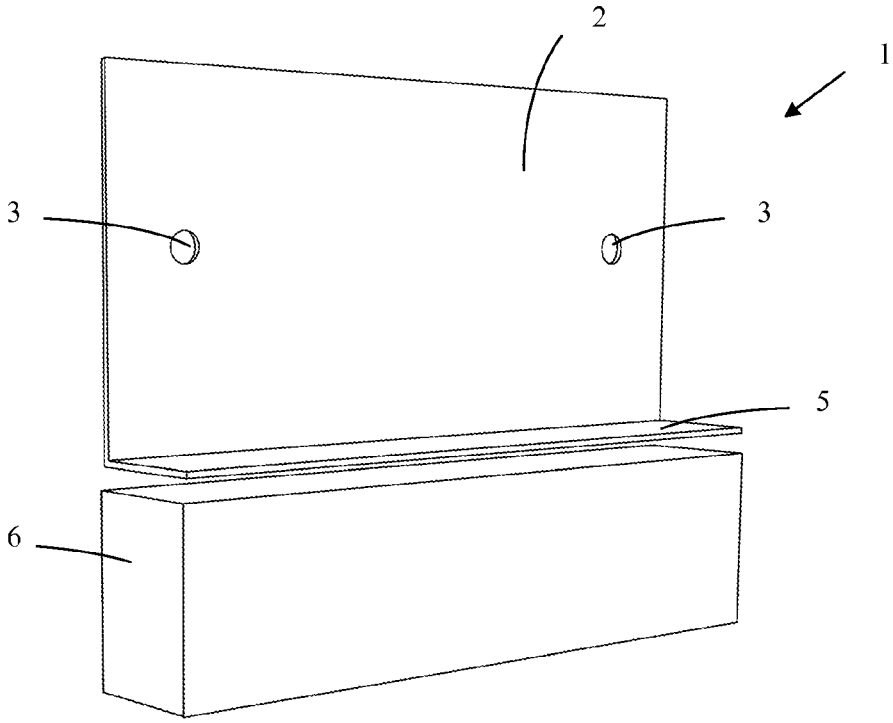
FIG. 2 is a diagram of a second embodiment of the jig of the present invention

Alternatively, jig 1 comprises indicator face 2 having an upper edge and lower edge, and a wall face and indicator face. The lower edge of flat plate 2 is bent at about 90 degrees to form window interface 5, as seen in FIG. 2. Window interface 5 allows the jig to fit along the edge of a window frame. Moreover, because window interface 5 is narrow, it may be placed on the window frame while a curtain or blinds headrail is still mounted to the window. Advantageously, this permits a user to place the jig without removing the window accessories or blinds. A series of position holes 3 that match those of the mounting bracket are cut into flat plate 2, allowing the jig to be used as described previously. Jig 1 also may include spacer block 6, which is adapted to engage window interface 5. Spacer block 6, which may be made of any material known in the art such as wood, thermoplastic, and metal, including alloys, is used in conjunction with the jig when the bracket is to be installed above window trim, and aligns with the window frame to allow a user to drill the position holes above the window.

Example 2

Figure 3:
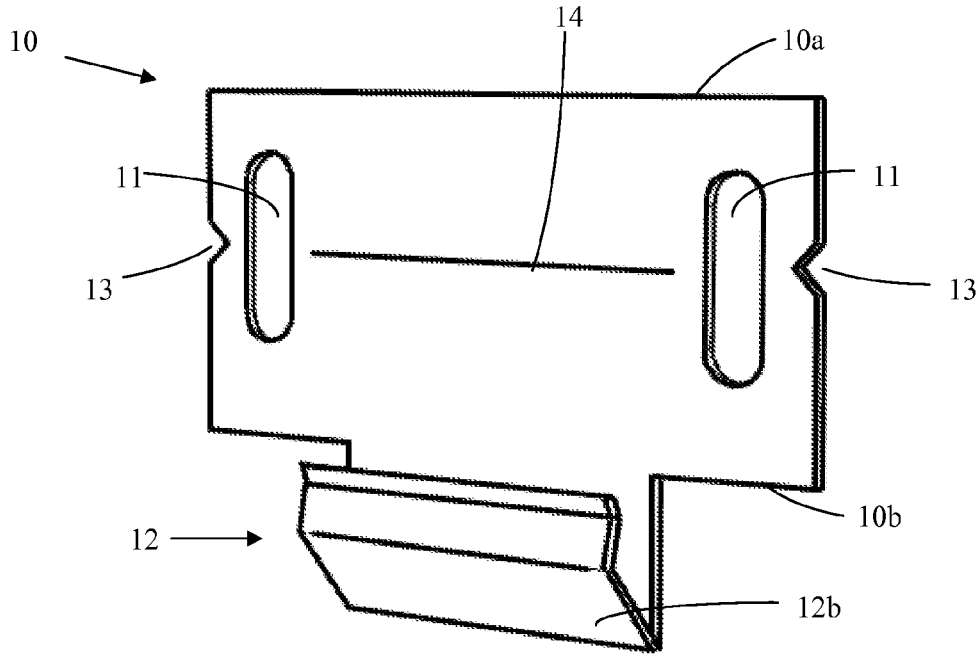
FIG. 3 is an isometric illustration of one variation of the inventive bracket.

Bracket 10 has a vertical face having upper edge 10*a* and lower edge 10*b*. Mounting holes 11 are disposed on its face. Mounting holes 11 of bracket 10 are specifically designed to be attached to the predrilled holes created by jig 1. As seen in FIG. 3, the holes may be oval, to permit vertical adjustments. However, mounting holes 11 may be circular, or any configuration known in the art. The lower edge of bracket 10 includes clip 12, which extends out from the face of the bracket and is used to hang the cornice.

The clip has a bend providing backward pressure on the cornice spine pulling it toward the wall. In one embodiment, a beveled clip edge extends from wall face edge 12*b* of the clip is positioned at a 45 degree angle from the face of bracket 10. The beveled side is opposite to a bevel edge on the spine of the cornice, placing the cornice's weight on the bracket and causing the cornice return to be further drawn against the wall.

In some variations, the brackets also include V-cutout 13 on each side of bracket 10 with level line 14 centered between the cuts. The V-cutout is a point of attaching string to the bracket but can be any method for achieving the same goal. The attachment point on each side of the bracket must be equally located on their respective sides as to provide a reference for leveling the bracket. If the cornice's length requires additional support towards its middle section additional brackets may be easily installed by using the V-cutouts. A piece of monofilament or other line is wrapped around one bracket with the line running through the outside edge V-cutout to the second bracket located at the opposite window corner. The line is then wrapped around the second bracket with the line running through the V-cutout at the outside edge of the bracket. Additional brackets may now be accurately placed along the top edge of the window opening by centering the V-cutout and level line with the line running from the first and second brackets already installed. Where mounting holes 11 are oval, the brackets may be adjusted vertically to align the brackets for final bracket placement. The additional brackets installed will now be level with the two outside brackets allowing equal distribution of weight and support.

Using the mounting holes created from the jig, the bracket is screwed to the wall such that the bracket's face having the screw holes is positioned just above the window opening. The lower portion of bracket 10 is positioned below the top of the window opening and matched with the cornice spine to allow the cornice to be positioned precisely at the top edge of the window.

Example 3

Figure 4:
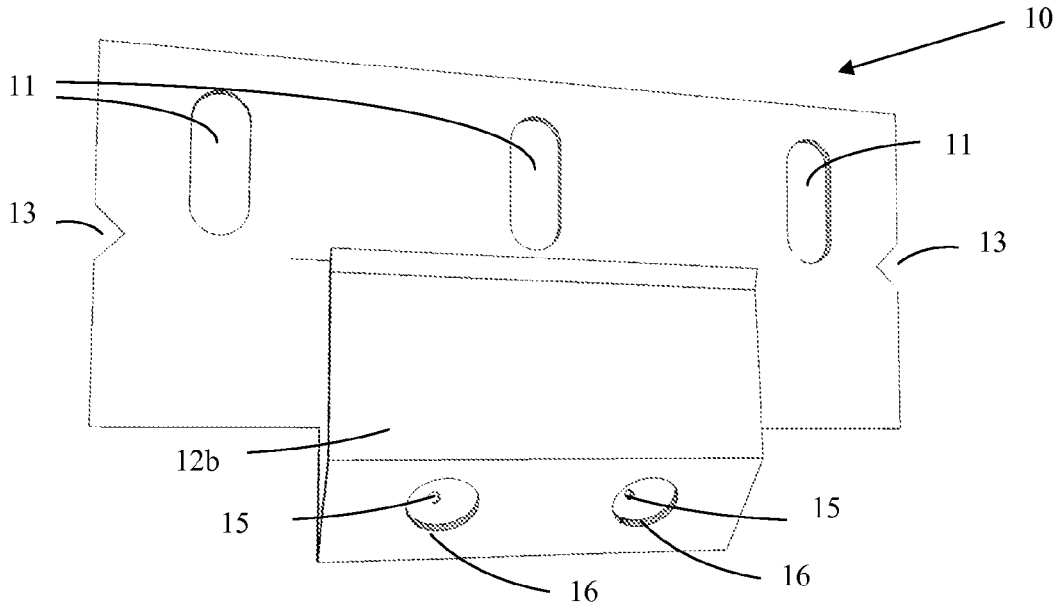
FIG. 4 is a front, isometric illustration of one variation of the inventive bracket showing accessory attachment holes.
Figure 5:
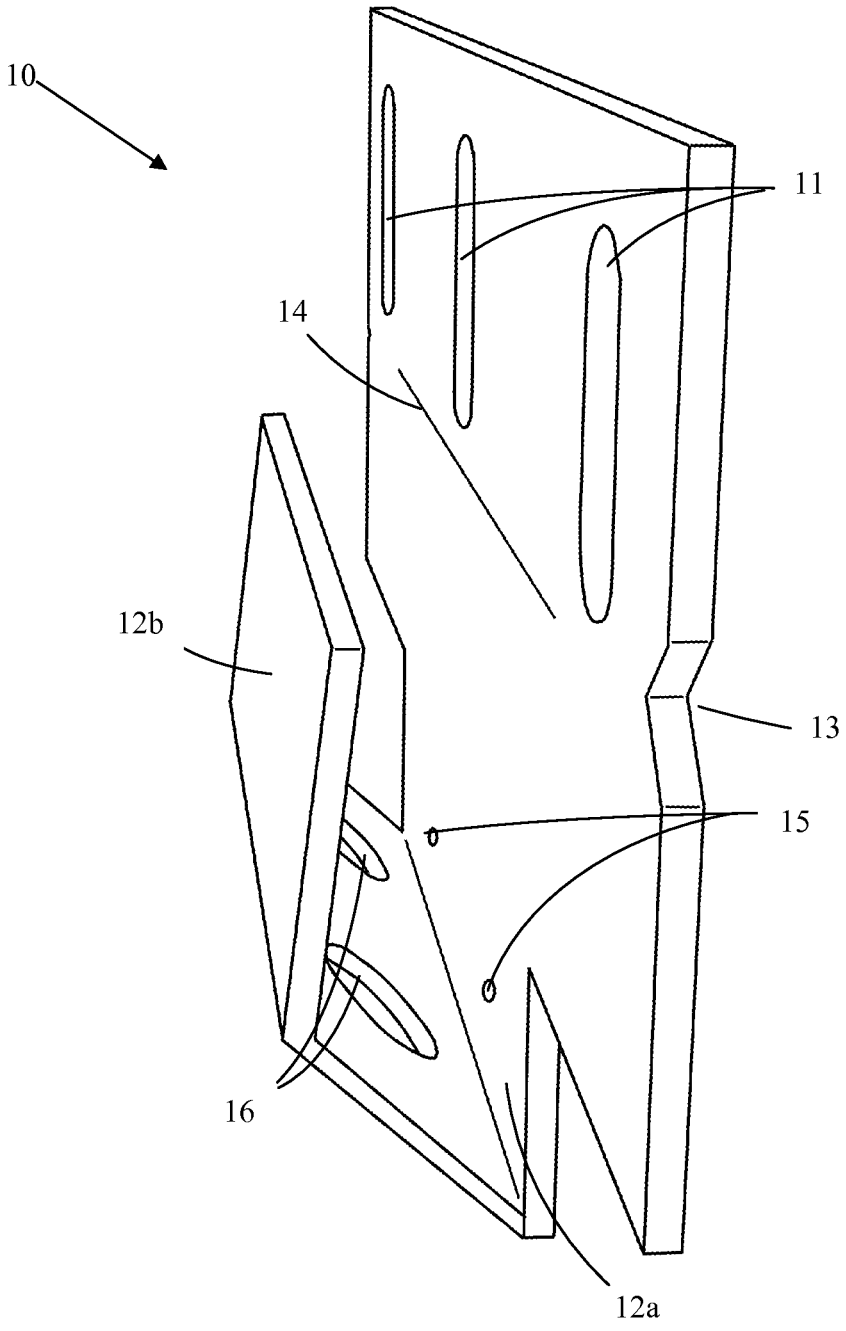
FIG. 5 is a side, isometric illustration of one variation of the inventive bracket showing accessory attachment holes.

Bracket 10 includes a vertical face having upper edge 10*a* and lower edge 10*b*. Three oval mounting holes 11 are cut into the vertical face, permitting vertical adjustment of the bracket, as seen in FIGS. 4 and 5. The inclusion of a third, middle hole permits mounting of the bracket to a surface where there is a structural member behind the surface such as a wall stud. In this case only the middle hole would be used, the bracket may self-level. Clip 12 is disposed on lower edge 10*b* of bracket 10 and extends out from the face of the bracket. Clip 12 has a bend adapted to interface with the cornice spine, as discussed in Example 2.

Figure 6:
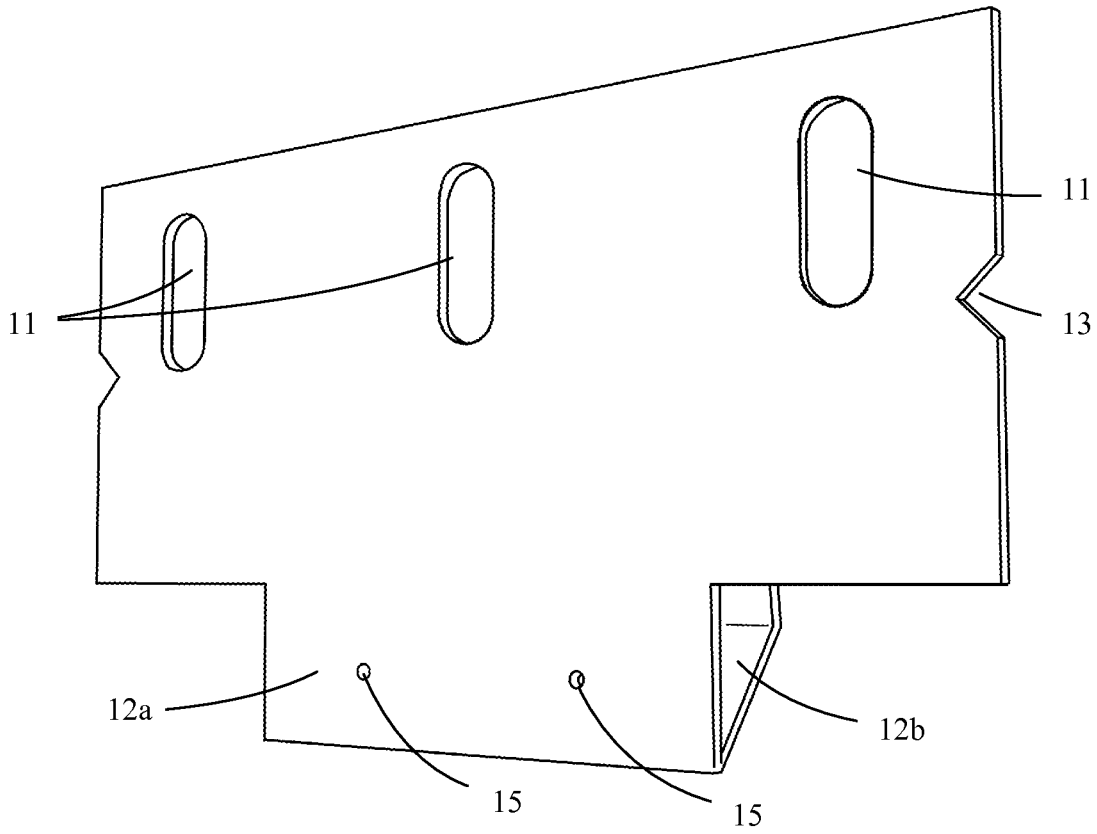
FIG. 6 is a back, isometric illustration of one variation of the inventive bracket showing accessory attachment holes.

As in the above Example 2, bracket 10 may include V-cutout 13 on each side of bracket 10 with level line 14 centered between the cuts to provide a reference for leveling the bracket, as seen in FIGS. 4-6.

Clip 12 possesses wall face 12*a*, which is connected to lower edge 10*b*, and may be an extension of lower edge 10*b*, and spine-interface 12*b*. Accessory screw holes 15 are disposed on wall face 12*a*. To permit easy attachment of accessory screws, screw access holes 16 are optionally disposed on spine-interface 12*b*, corresponding to an accessory screw hole. To attach accessories, a screw is inserted through screw access hole 16 and into the corresponding accessory screw hole 15. The accessory is placed adjacent to wall face 12*a* and the screw tightened, thereby fixing the accessory to the bracket.

Figure 7:
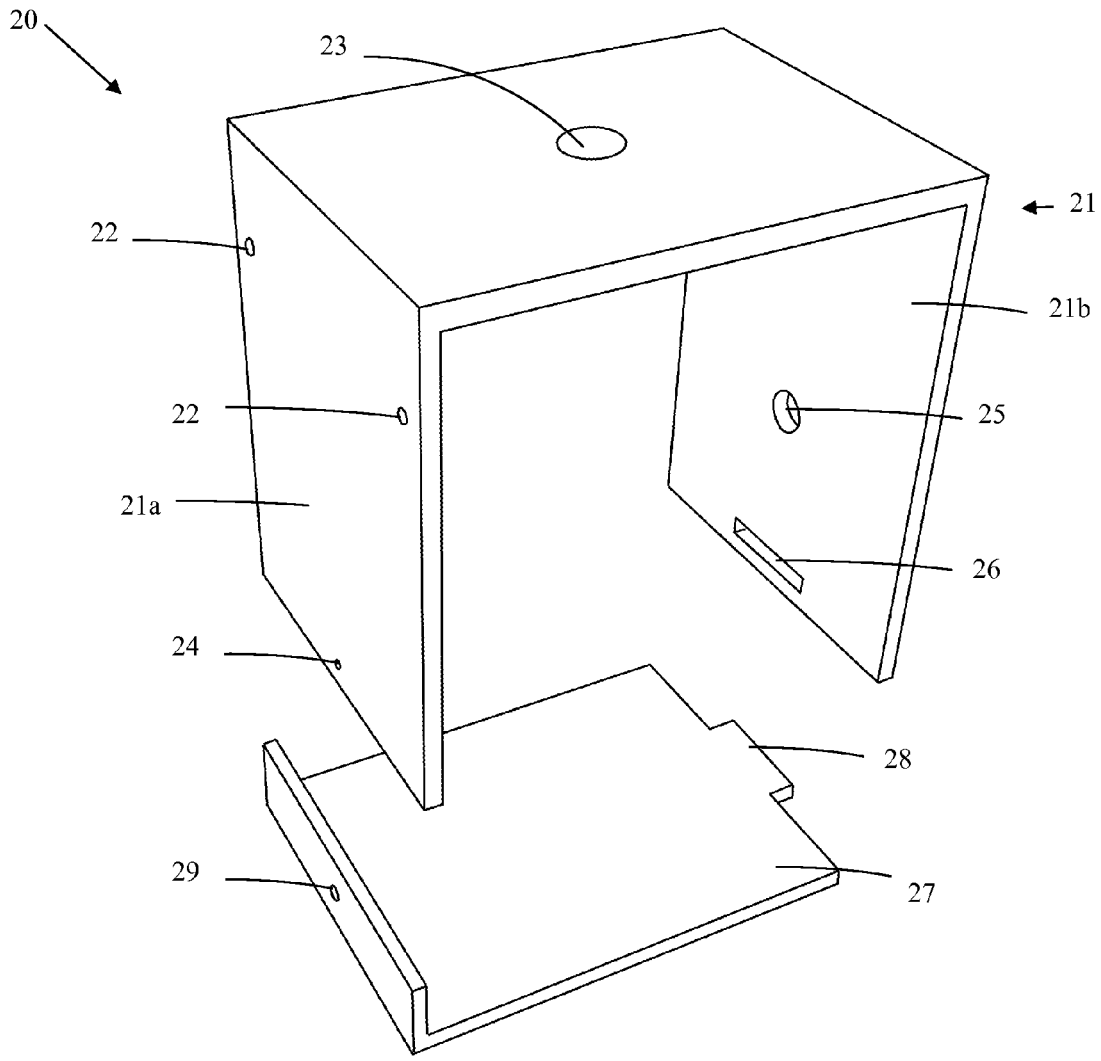
FIG. 7 is an isometric illustration of a mini blind box accessory attachment for use with the bracket.
Figure 8:
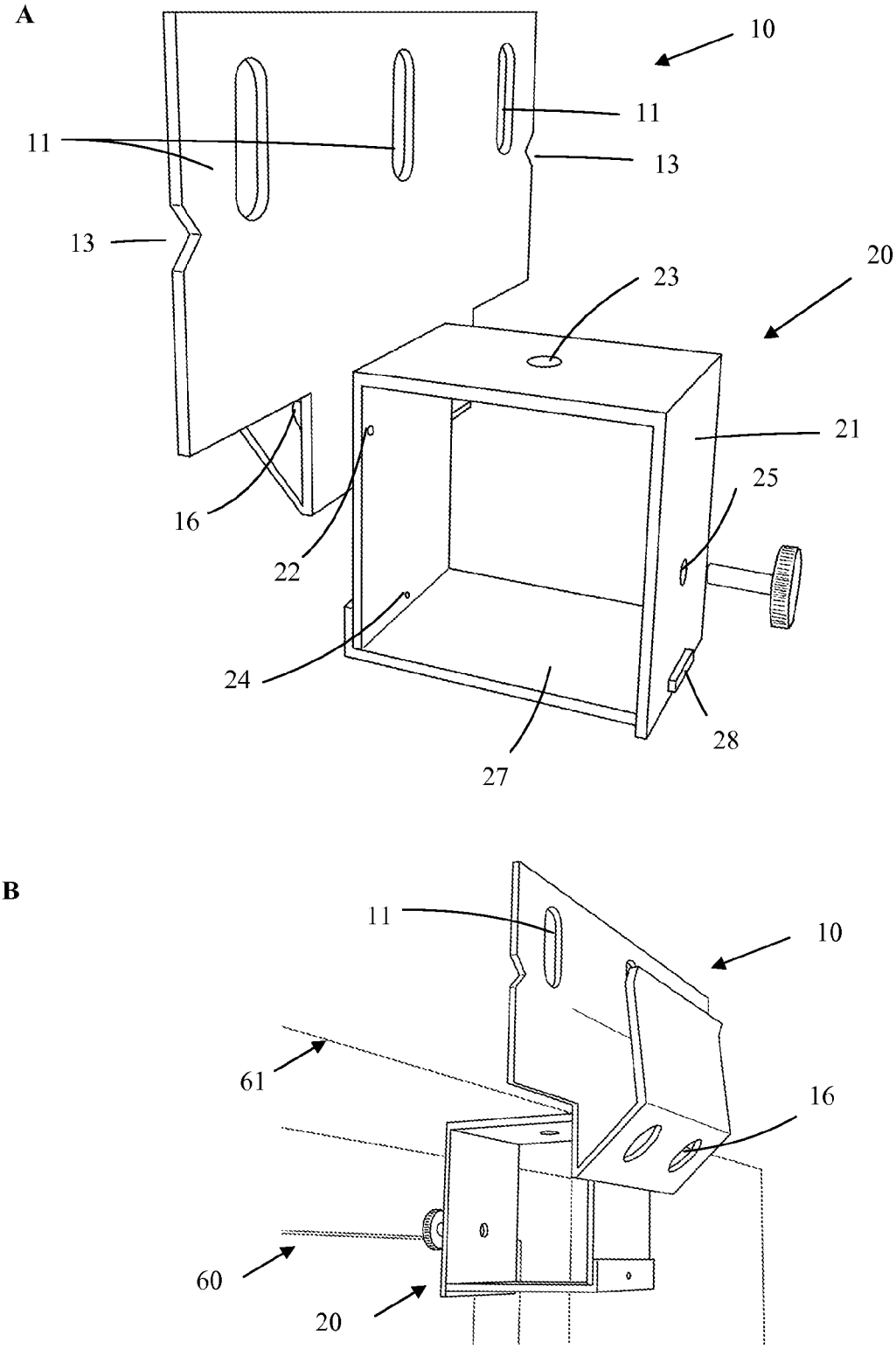
FIGS. 8(A) and (B) are isometric illustrations showing (A) the mini blind box accessory attachment connected to the bracket; and (B) the mini blind box accessory attachment connected to the bracket prior to mounting to a window frame.

The accessory may include a mini blind box 20, as seen in FIGS. 7 and 8(A). The mini blind box is secured to the bracket by screws extending from corresponding accessory screw hole 15. The mini blind box is formed from two sections mini blind body 21 and mini blind base 27. Mini blind body 21 includes blind set screw hole 25, and blind security tab opening 26 on blind locking face 21*b*, blind mounting hole 23, found on the topmost face of mini blind body 21, and blind box fixation holes 22 and blind security hole 24 found on bracket interface 21*a*.

The screws from accessory screw hole 15 extend to blind box fixation holes 22 and are inserted into blind box fixation holes 22. The screws are tightened, fixing the mini blind box to bracket 10, as seen in FIG. 8(A). Once secured to the bracket, bracket 10 is installed in window 60, such that lower edge 10*b* is aligned with the edge of the window 61 and the mini blind box is flush against the top of the window opening, as seen in FIG. 8(B). A mounting screw is placed in blind mounting hole 23 and screwed into the top of the window frame, thereby securing the mini blind box to the top of the window opening.

Mini blinds are lifted into the opening of the box and mini blind base 27 secured in place by inserting security tab 28 into blind security tab opening 26 on blind locking face 21*b*. Blind security hole 24 is aligned with base security hole 29 and a screw is fitted into both holes, securing mini blind base 27 to mini blind body 21. A threaded thumb screw is placed into blind set screw hole 25, and used to secure the blind head rail in place.

Figure 9:
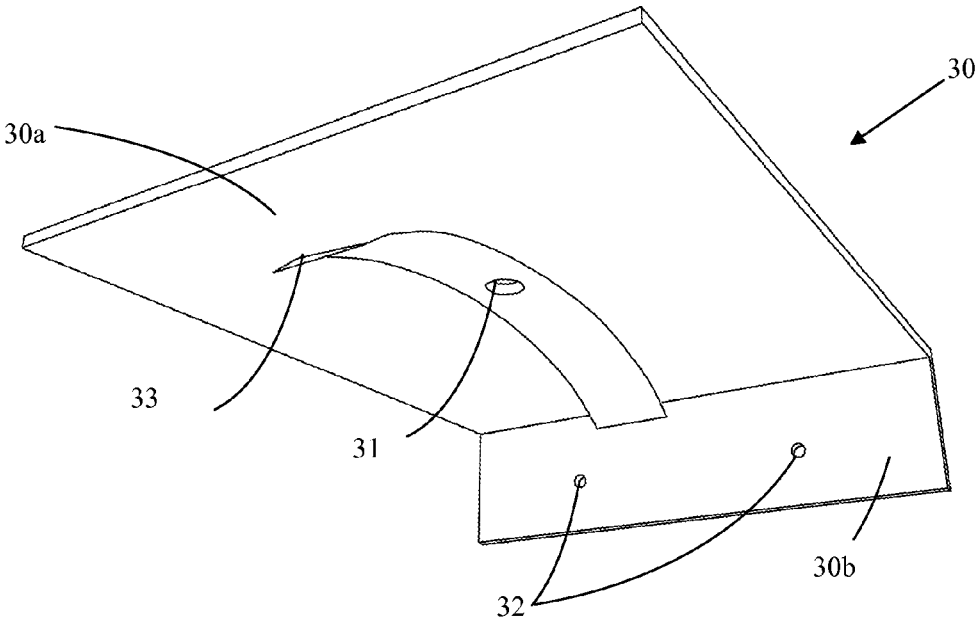
FIG. 9 is an isometric illustration of an accessory clip attachment for use with the bracket.
Figure 10:
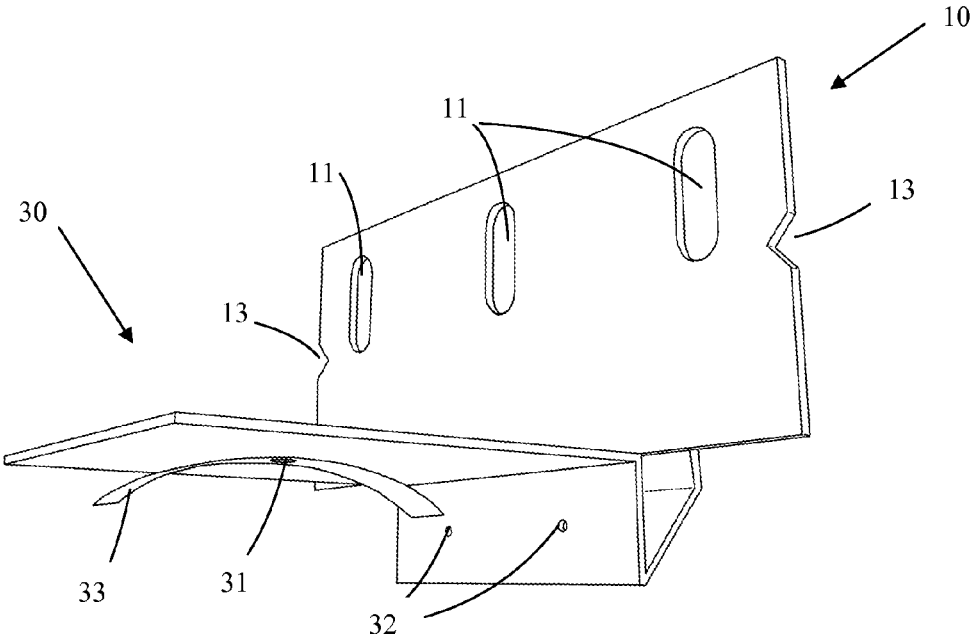
FIG. 10 is an isometric illustration of an accessory clip attachment connected to the bracket.

Accessory bracket 30 includes bracket face 30*a* and bracket interface 30*b*, as seen in FIG. 9. Mounting hole 31 is disposed in bracket face 30*a*, with blind clip 33 affixed to bracket face 30*a* at the same location as screw hole 31. A series of accessory blind fixation holes 32 are disposed on bracket face 30*b*. The screws from accessory screw hole 15 extend to accessory blind fixation holes 32 and are tightened, fixing accessory bracket to bracket 10, as seen in FIG. 10. Once secured to the bracket, bracket 10 is installed in the window, with lower edge 10*b* aligned with the edge of the window and the top of bracket face 30*a* flush against the top of the window opening. A mounting screw is placed in mounting hole 31 and screwed into the top of the window frame, securing the accessory bracket to the top of the window opening.

Blind clip 33 is used to secure a vertical blind head rail to the bracket. Other exemplary accessories that may be attached using the accessory bracket include mini blinds, a mini blind adapter, a curtain rod or shade, or other adapter known in the art. This provides one bracket installation that is used for both the cornices and blinds, advantageously reducing installation time and hardware. Additionally, the blind hardware is correctly positioned in the window opening.

Figure 11:
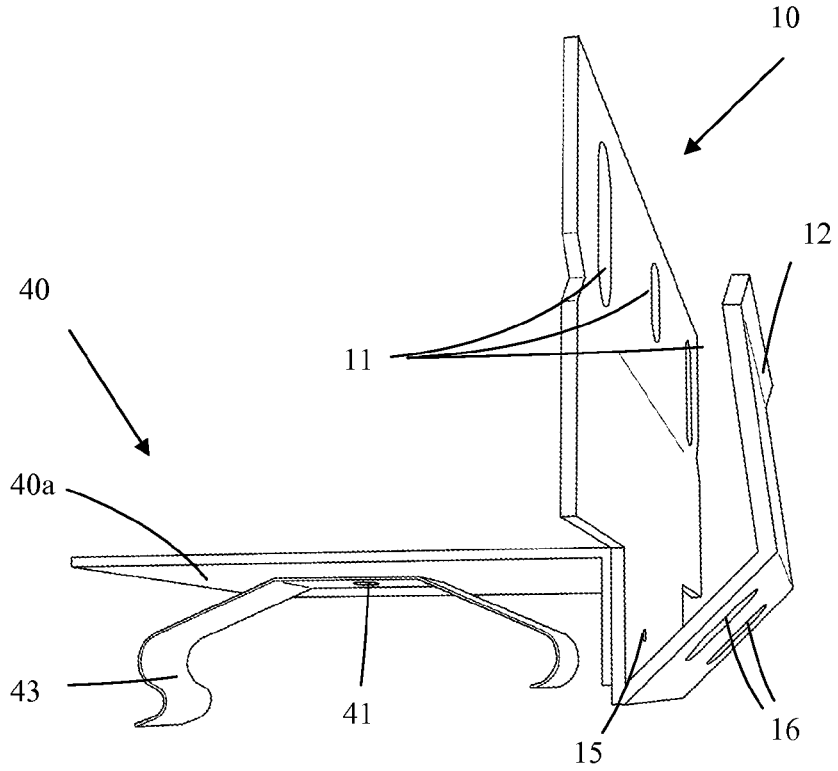
FIG. 11 is an isometric illustration of a variation of an accessory clip attachment for use with the bracket.
Figure 12:
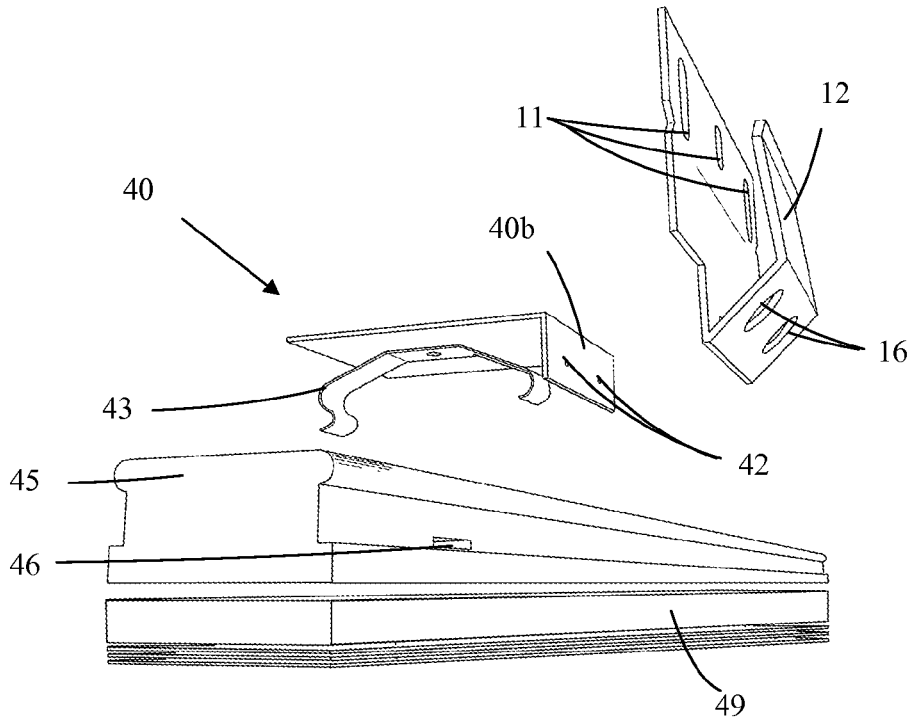
FIG. 12 is an isometric illustration of a variation of an accessory clip attachment shown in a configuration for attaching to mini blinds and to the bracket.

Blind bracket 40 includes blind bracket face 40*a* and bracket interface 40*b*, seen in FIGS. 11 and 12. As with accessory bracket 30, blind bracket 40 is mounted to accessory screw hole 15 using a screw, which extends to blind bracket fixation holes 42. Once secured to the bracket, bracket 10 is installed in the window, with lower edge 10*b* aligned with the edge of the window and the top blind bracket face 40*a* flush against the top of the window opening. A mounting screw is placed in blind bracket mounting hole 41 and screwed into the top of the window frame, securing the accessory bracket to the top of the window opening. A piece of Velcro or other material is placed through Velcro access hole 46 and wrapped around mini blinds head rail 49, connecting the mini blinds to the mini blind adapter rail and the window. Mini blind adapter rail 45 is snapped into vertical blinds clip 43, locking mini blind adapter rail 45 into blind bracket 40 and fixing mini blind adapter rail 45 to the window.

Example 4

Figure 13:
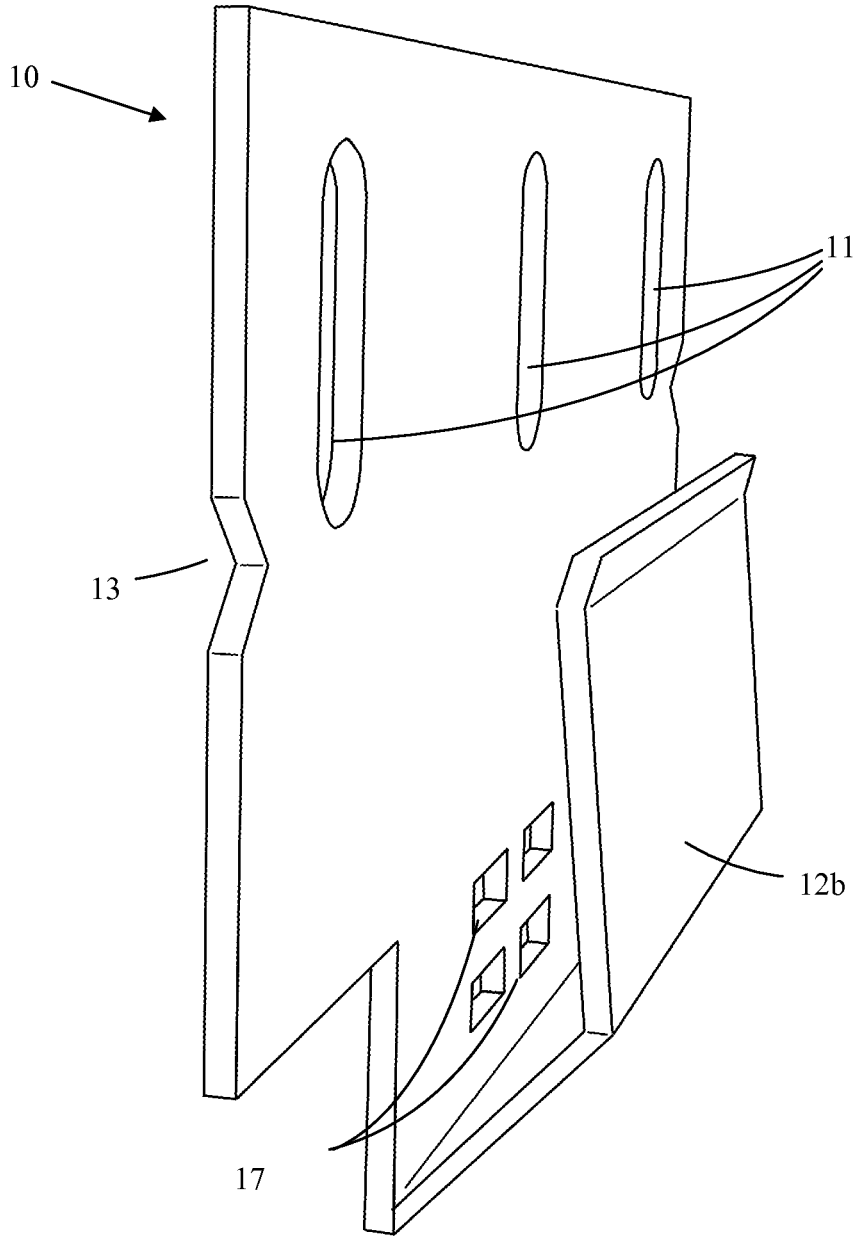
FIG. 13 is a side, isometric illustration of one variation of the inventive bracket showing accessory attachment tab slots.

Bracket 10 provides a vertical face having with three oval mounting holes 11 cut into the vertical face, permitting vertical adjustment of the bracket, seen in FIG. 13. As in Example 2, bracket 10 may include V-cutout 13 on each side of bracket 10 with level line 14. Lower edge 10*b* of bracket 10 connects to clip 12, which extends out from the face of the bracket. Clip 12 has a bend adapted to interface with the cornice spine, as discussed in Example 2.

Clip 12 includes wall face 12*a*, connected to lower edge 10*b*, such as an extension of lower edge 10*b*, and spine-interface 12*b*. Tab insertion holes 17 are disposed on wall face 12*a*, and are adapted to accept tabs from an accessory. Exemplary accessories include a bracket having L-shaped tabs corresponding to tab insertion holes 17, or arrow-shaped, "snap-in" insert tabs, as known in the art.

Example 5

Figure 14:
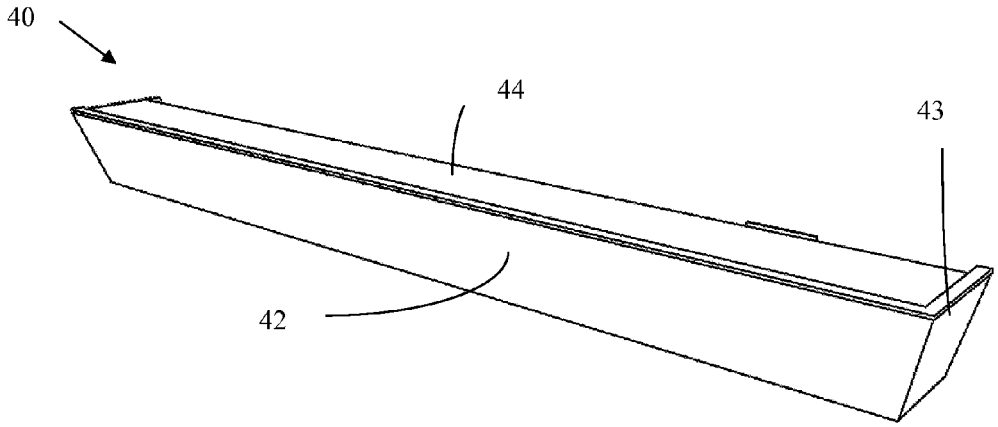
FIG. 14 is a diagram of the front aspect of the cornice of the present invention.
Figure 15:
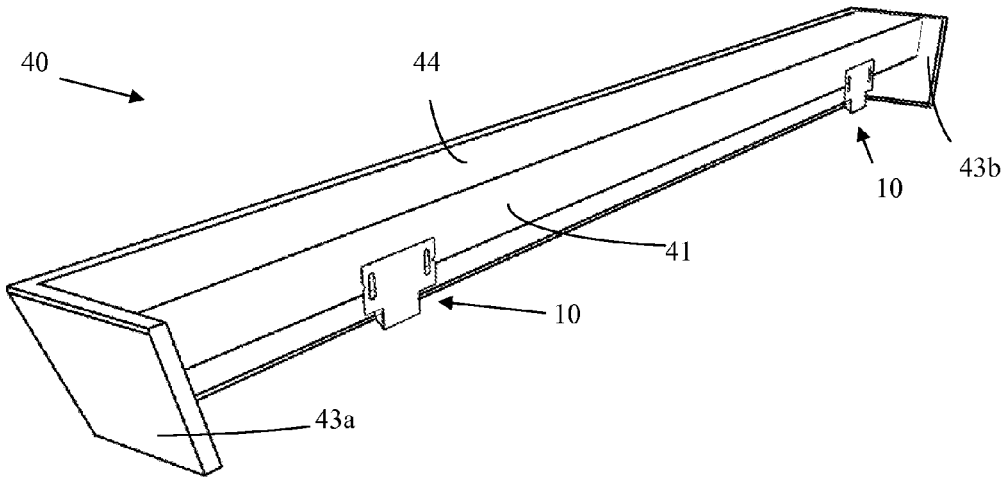
FIG. 15 is a diagram showing the back aspect of the cornice of the present invention with the brackets adjacent to the spine.

Cornice 40 is built around cornice spine 41, as seen in FIG. 15. Decorative elements, such as front 42 and side returns 43*a* and 43*b*, seen in FIGS. 14 and 15, are added to spine 41. Strongback 44 may also be attached to front 42 and side returns 43*a* and 43*b* (collectively 43), further supporting the construction of cornice 40 and preventing dust from contacting any optional curtains or other window treatments hung below the cornice. The cornice works in concert with the bracket, described in Examples 2-4, by mating the cornice spine 41 to the bracket using clip 12, as seen in FIG. 15. Cornice spine 41 possesses a beveled spine edge 41*a*, which is complementary to the beveled clip edge extending from wall face edge 12*b*. The opposing bevels of the bracket and spine permit the spine to engage bracket 10, and also help pull the cornice to the wall or surface as the weight of the cornice sets on the brackets. Cornice spine 41 may be made of any material provided it is able to support the weight of the cornice.

Figure 16:
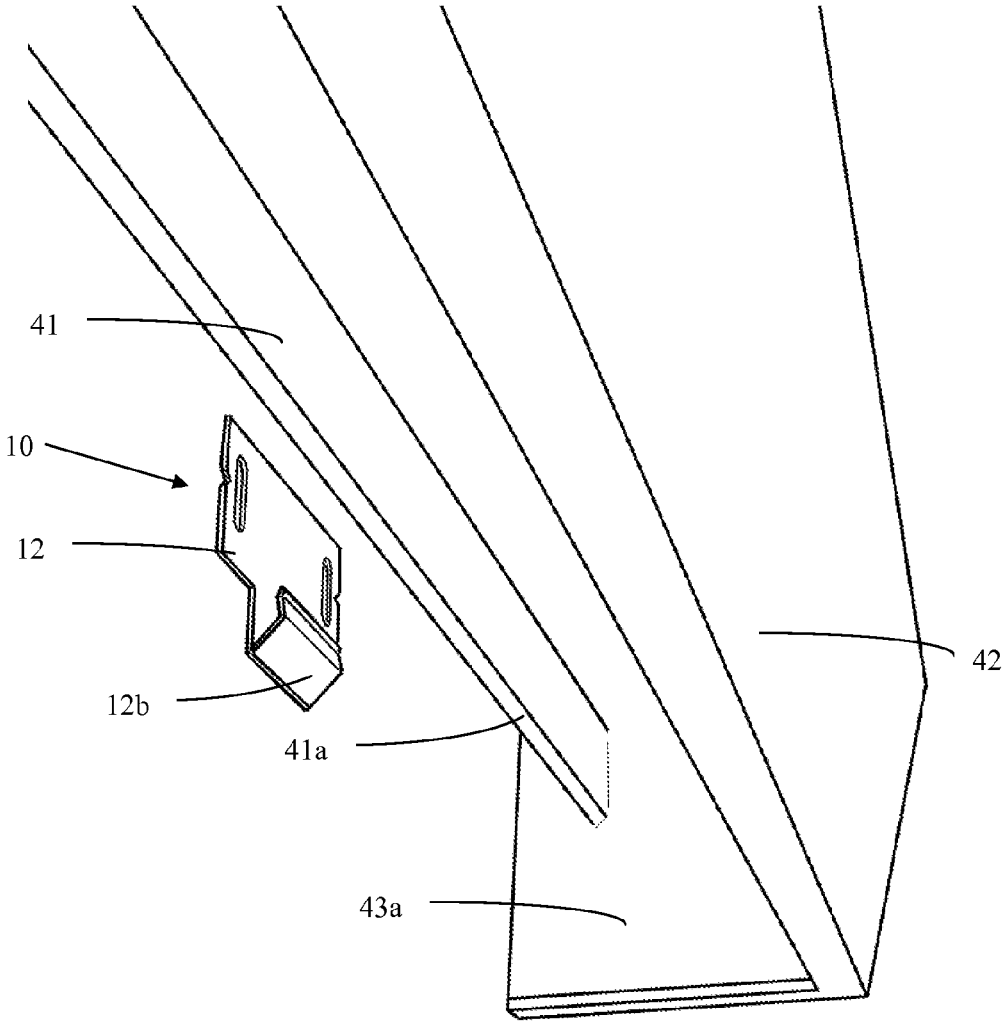
FIG. 16 is a diagram showing the underneath of the cornice of the present invention with the brackets expanded from the spine.
Figure 17:
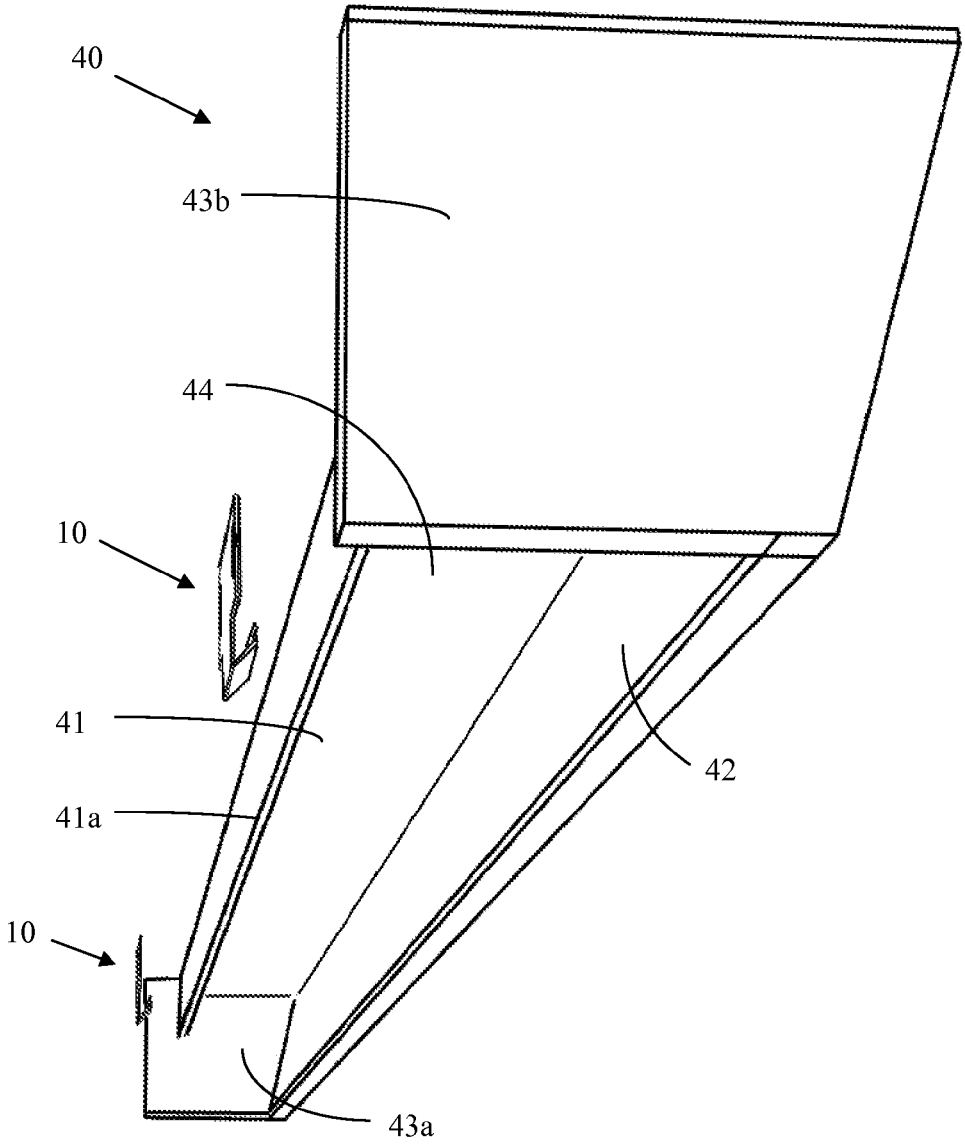
FIG. 17 is a diagram showing the back aspect of the cornice of the present invention with the brackets shown expanded from the spine.

The cornice spine is connected to front 42 and side returns 43*a* and 43*b* via the top (strongback), by mounting to the side returns, or mounting to the back of the front. Alternatively, cornice spine 41 may be created on the back side of the cornice by carving or routing the back face of front 42 or bottom face of strongback 44, or other methods known in the art. The cornice may also be hung by using the treatment itself if made thin enough to fit into the bracket. Of particular importance, cornice spine 41 must possess adequate depth to fit into clip 12 of bracket 10. As seen in FIGS. 16 and 17, cornice spine 41 is nailed to the side returns, though any other attachment means known in the art may be used to attach the cornice spine to the returns.

Cornice spine 41 is positioned on the back portion of the cornice and typically runs the length or substantially the length of the cornice, from one return to the other. However, in other variations the cornice spine is shortened to some extent, such as only running about ⅓ or ¼ the length of the cornice, from the returns. The top of the cornice rests on the spine in any fashion and may be attached either through screws, dowels or some other means but does not require so if the spine is attached at the returns. The spine is set to a forward position from the rear edge of the return which comes in contact with the wall or surface creating a "leg" on each return. When the cornice is mounted to the bracket the offset which creates the "leg" provides a space or void between the cornice and the wall. The created space allows room for the bracket and hardware as well as any trim that may be around a window and allows the cornice to be drawn to the wall without interference.

The spine is positioned into the bracket, which is mounted to a surface like a wall, thereby fixing the cornice to the surface. The bracket then provides support for the cornice and any other accessory applied to or connected to the cornice. The bottom edge of the spine has a beveled edge that is opposing to that of the bracket which is meant to draw the cornice towards the wall or surface as weight is applied downward on the cornice. The back side of the spine, which faces the wall or other mounting surface, may have a return to accommodate hardware used to attach the brackets to the wall or surface. Alternatively, the inside of each side return is optionally predrilled or mounted with hardware to accept curtain rods or other features.

In certain variations, the edge of the return that comes in contact with the wall or surface has a material or coating to allow limited movement of the cornice, allowing the return to glide over the wall or surface as the cornice is lowered into position and drawn towards the wall or surface after it is initially installed on the brackets. Examples of coating include, but are not limited to, Teflon polyester, para-phenylenediamine, terephthaloyl chloride polymer, carbon fiber, expanded PTFE, meta-phenylenediamine, terephthaloyl chloride polymer, nylon, fiber glass, cotton, polypropylene, latex, silicone, polyurethane, polyisoprene, polystyrene and polybutadiene polymer, urethane, polyethylene, polyisoprene, polyvinylchloride, ethylene propylene diene monomer, neoprene, styrene butadiene, cornstarch powder, graphite, Nomex, nylon, fiber glass, cotton, Gore-Tex, Kevlar, and carbon fiber. In addition, such coatings also allow positioning and adjusting of the cornice to a centered or desired position by moving the cornice left or right of its current position.

Other variations of usage for the bracket and cornice may be apparent to one of skill in the art. For example, the bracket may be mounted to any flat surface, such as mounting above window trim or on a wall. Moreover, the cornice may be used as a mantel, shelf or above a picture for lighting.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of a bracket and spine-centered cornice and method for installation it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention which, as a matter of language, might be said to fall therebetween.

What is claimed is:

1. A wall treatment comprising at least one bracket adapted to accept a spine element, wherein the brackets further comprise a flat plate having an upper edge and lower edge, and a wall face and indicator face;

at least one hole disposed on the flat plate;

a clip disposed on the lower edge, wherein the clip further comprises a beveled clip edge angled from the indicator face;

a retention support disposed on the beveled clip edge, wherein the retention support is angled toward the flat plate and adapted to apply pressure to the face of an at least one spine element;

a decorative element comprising a front face having a first horizontal end and a second horizontal end, and a top edge and a bottom edge;

a first return having a first edge and a second edge, wherein the first edge is disposed on the first horizontal end of the front face;

a second return having a first edge and a second edge, wherein the first edge is disposed on the second horizontal end of the front face; and the at least one spine element attached to the first return and the second return, where the at least one spine element is adapted to support the weight of a structure, wherein the at least one spine element has a beveled lower edge adapted to engage the beveled clip edge in the clip;

wherein the at least one spine element is intermediate with the first edge and the second edge of the first return and is intermediate with the first edge and the second edge of the second return;

wherein the clip is adapted to provide backward pressure when the spine element is inserted into the clip.

2. The wall treatment of claim 1, wherein the decorative element further comprises a strongback disposed on the top edge of the front face;

wherein the at least one spine element is attached to the strongback.

3. The wall treatment of claim 1, wherein the decorative element is made of wood, plastic, metal, glass, ceramic, or a combination thereof.

4. The wall treatment of claim 2, further comprising at least one hardware disposed in the interior face of the first return and the second return, wherein the hardware is adapted to accept curtain rods, lighting, blind hardware, or rings.

5. The wall treatment of claim 2, further comprising a coating disposed on second edge of the first return and second return, wherein the coating is Teflon, polyester, para-phenylenediamine and terephthaloyl chloride polymer, carbon fiber, expanded PTFE, meta-phenylenediamine, terephthaloyl chloride polymer, nylon, fiber glass, cotton, polypropylene, latex, silicone, polyurethane, polyisoprene, polystyrene and polybutadiene polymer, urethane, polyethylene, polyisoprene, polyvinylchloride, ethylene propylene diene monomer, neoprene, styrene butadiene, cornstarch powder, graphite, Nomex, nylon, fiber glass, cotton, Gore-Tex, Kevlar, or carbon fiber.

6. The wall treatment of claim 1, wherein the bracket is made of carbon steel, galvanized steel, low alloy steel, stainless steel, surgical steel, titanium alloy, thermoplastic, Kevlar, carbon fiber, or fiberglass.

7. The wall treatment of claim 1, wherein the at least one hole is oval, rectangular, or circular.

8. The wall treatment of claim 1, wherein the spine has an angled lower edge, and where the bracket beveled clip edge is angled complementary to the spine.

9. The wall treatment of claim 1, further comprising a jig, wherein the jig further comprises a flat plate having an upper edge and lower edge, and a wall face and indicator face;

a plurality of position holes disposed on the indicator face; and a stop disposed on the lower edge of flat plate and on the wall face of the jig.

10. A method of installing a wall treatment, comprising positioning a plurality of holes onto a mounting surface;

drilling the plurality of holes into the mounting surface;

fixing a plurality of brackets onto the mounting surface, wherein the brackets further comprise a flat plate having an upper edge and lower edge, and a wall face and indicator face;

at least one hole disposed on the flat plate;

a clip disposed on the lower edge, wherein the clip further comprises a beveled clip edge angled from the indicator face;

a retention support disposed on the beveled clip edge, wherein the retention support is angled toward the flat plate and adapted to apply pressure to the face of an at least one spine element;

fixing a decorative element to the plurality of brackets, wherein the decorative element further comprises a front face having a first horizontal end and a second horizontal end, and a top edge and a bottom edge;

a first return having a first edge and a second edge, wherein the first edge is disposed on the first horizontal end of the front face;

a second return having a first edge and a second edge, wherein the first edge is disposed on the second horizontal end of the front face; and at least one spine element attached to the first return and the second return, where the at least one spine element is adapted to support the weight of a structure, wherein the at least one spine element has a beveled lower edge adapted to engage the bend in the clip;

wherein the at least one spine element is intermediate with the first edge and the second edge of the first return and is intermediate with the first edge and the second edge of the second return;

wherein the beveled clip edge of the bracket is adapted to accept a spine element.

11. The method of claim 10, wherein the decorative element further comprises a strongback disposed on the top edge of the front face;

wherein the at least one spine element is attached to the strongback.

12. The method of claim 10, further comprising aligning the plurality of brackets prior to fixing the brackets to the mounting surface; comprising providing the plurality of brackets wherein the plurality of brackets further comprise at least one V-cutout disposed on at least one side edge of the flat plate of the bracket;

a level line is disposed on the indicator face between the plurality of V-cutouts; and running a plumb line or level line from the at least one V-cutout disposed on a first bracket to the at least one V-cutout disposed on a second bracket.

13. The wall treatment of claim 1, wherein the bend in the clip is angled between 30 degrees and 60 degrees.

14. The wall treatment of claim 13, wherein the bend in the clip is angled at 45 degrees.

15. The wall treatment of claim 1, further comprising a screw-mounting system, wherein the screw-mounting system comprises a plurality of holes disposed on the support face of the clip; and a plurality of holes disposed on the clip face of the clip; or a tab mounting system, wherein the tab mounting system comprises a plurality of square or rectangular openings disposed on the support face of the clip.

* * * * *